US007762551B1

(12) United States Patent
Wu et al.

(10) Patent No.: US 7,762,551 B1
(45) Date of Patent: Jul. 27, 2010

(54) PAPER FEEDING MODULE AND MULTI-FUNCTION PERIPHERAL HAVING THE SAME

(75) Inventors: Yen-Jui Wu, Taipei County (TW); Ming-Chih Huang, Taipei County (TW)

(73) Assignee: Kinpo Electronics, Inc., Taipei County (TW)

( * ) Notice: Subject to any disclaimer, the term of this patent is extended or adjusted under 35 U.S.C. 154(b) by 0 days.

(21) Appl. No.: 12/430,325

(22) Filed: Apr. 27, 2009

(51) Int. Cl.
*B65H 5/02* (2006.01)

(52) U.S. Cl. ..... 271/279; 271/292; 271/294

(58) Field of Classification Search ..... 271/279, 271/292, 294, 303, 213, 298, 270, 300; 74/435
See application file for complete search history.

(56) References Cited

U.S. PATENT DOCUMENTS 5,217,215 A * 6/1993 Ohata et al. ..... 270/58.16
5,497,984 A * 3/1996 Murakami et al. ..... 270/58.02
5,553,528 A * 9/1996 Zoltner ..... 83/443
6,705,603 B1 * 3/2004 Kirino et al. ..... 270/12
2003/0080498 A1 * 5/2003 Noh ..... 271/213

* cited by examiner

*Primary Examiner*—Kaitlin S Joerger
(74) *Attorney, Agent, or Firm*—J.C. Patents

(57) ABSTRACT

A multi-function peripheral includes a main body and a paper feeding module which includes a paper outlet structure, a tray and a gate. The paper outlet structure is disposed at the main body and has a first paper outlet and a second paper outlet below the first paper outlet. The tray is disposed movably up and down at the paper outlet structure, so as to support papers fed out from the paper outlet structure. The gate is pivoted at the paper outlet structure and near the second paper outlet. When the papers are fed out from the first paper outlet, the tray is below the first paper outlet and the gate covers the second paper outlet. When the papers are fed out from the second paper outlet, the tray is below the second paper outlet and the gate does not cover the second paper outlet.

8 Claims, 7 Drawing Sheets

PAPER FEEDING MODULE AND MULTI-FUNCTION PERIPHERAL HAVING THE SAME

BACKGROUND OF THE INVENTION

1. Field of the Invention

The present invention is related to a paper feeding module and a multi-function peripheral using the same, and particularly to a paper feeding module having two paper outlets and a multi-function peripheral using the same.

2. Description of Related Art

As the information society arrives, office automatic equipment such as scanners, photocopiers or printers are disposed in offices, and users may perform secretarial processing operations using these office automatic equipment. It should be noted that when the above plurality of office automatic equipment is simultaneously disposed in the office, a lot of space is consumed. Hence, multi-function peripherals (MPFs) integrating functions such as copying, printing and scanning are developed to solve the above problems.

The multi-function peripherals also have paper folding functions to meet requirements of the users. However, if the multi-function peripherals have only one paper outlet, papers which are unfolded and papers that are folded are fed out from the same paper outlet, thereby causing the papers accumulating at the paper outlet unclassified. Hence, if the papers which are unfolded and the papers which are folded are made to be fed out from different paper outlet, the above problem of the papers being unclassified and untidily accumulated is solved.

SUMMARY OF THE INVENTION

The present invention provides a paper feeding module having two paper outlets.

The present invention provides a multi-function peripheral, wherein a paper feeding module thereof has two paper outlets.

The present invention provides a paper feeding module used to feed out a plurality of papers. The paper feeding module includes a paper outlet structure, a tray and a gate. The paper outlet structure has a side, a first paper outlet disposed on the side and a second paper outlet disposed on the side, wherein the first paper outlet is disposed above the second paper outlet, and the papers are adapted to be fed out from the first paper outlet or the second paper outlet. The tray is disposed movably up and down on the side and used to support the papers fed out from the first paper outlet or the second paper outlet. The gate has a pivoting part and is pivoted on the side and near the second paper outlet using the pivoting part. When the papers are fed out from the first paper outlet, the tray is disposed below the first paper outlet, and the gate is closed to the side and covers the second paper outlet. When the papers are fed out from the second paper outlet, the tray is disposed below the second paper outlet, and the gate has a specific angle relative to the side and does not cover the second paper outlet.

The present invention provides a multi-function peripheral which includes a main body and a paper feeding module. The paper feeding module is used to feed out a plurality of papers. The paper feeding module includes a paper outlet structure, a tray and a gate. The paper outlet structure is disposed at the main body and has a side, a first paper outlet disposed on the side and a second paper outlet disposed on the side, wherein the first paper outlet is disposed above the second paper outlet, and the papers are adapted to be fed out from the first paper outlet or the second paper outlet. The tray is disposed movably up and down on the side and used to support the papers fed out from the first paper outlet or the second paper outlet. The gate has a pivoting part and is pivoted on the side and near the second paper outlet using the pivoting part. When the papers are fed out from the first paper outlet, the tray is disposed below the first paper outlet, and the gate is closed to the side and covers the second paper outlet. When the papers are fed out from the second paper outlet, the tray is disposed below the second paper outlet, and the gate has a specific angle relative to the side and does not cover the second paper outlet.

According to an embodiment of the present invention, the above paper feeding module further includes a gear and a transmission structure. The gear is connected to the pivoting part and has a circumference part. The circumference part has a meshing area and a non-meshing area. The transmission structure is coupled to the gear, wherein the gear is adapted to be driven by the transmission structure through the meshing area, so as to make the gate closed to the side rotate to the specific angle or to make the gate rotated to the specific angle return to being closed to the side.

According to an embodiment of the present invention, the above multi-function peripheral includes a paper folding module. The transmission structure is used to drive the paper folding module to fold the papers, and the papers after being folded are fed out from the second paper outlet.

According to an embodiment of the present invention, the above paper feeding module further includes at least a torsion spring disposed at the pivoting part. When the transmission structure drives the gate to return to being closed to the side, the gate completely covers the second paper outlet using elasticity of the torsion spring.

According to an embodiment of the present invention, a material of the above pivoting part is metal.

Due to the above, the paper feeding module of the multi-function peripheral of the present invention has the first paper outlet and the second paper outlet, so as to make papers processed differently (for example papers which are folded and papers which are unfolded) be respectively fed out from the first paper outlet and the second paper outlet and be supported by the tray suitable for moving up and down and corresponding to the first paper outlet or the second paper outlet, so as to achieve effects of classification of the papers and tidy arrangement of the papers. In addition, when the papers are fed out from the first paper outlet, the gate covers the second paper outlet, so as to prevent the papers fed out from the first paper outlet from being inserted into the second paper outlet. When the papers are fed out from the second paper outlet, the gate does not cover the second paper outlet, so that the papers are fed out from the second paper outlet. During a process of the tray moving up and down, the gate is in a status of being closed to the side, so as to avoid interfering with movement of the tray.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
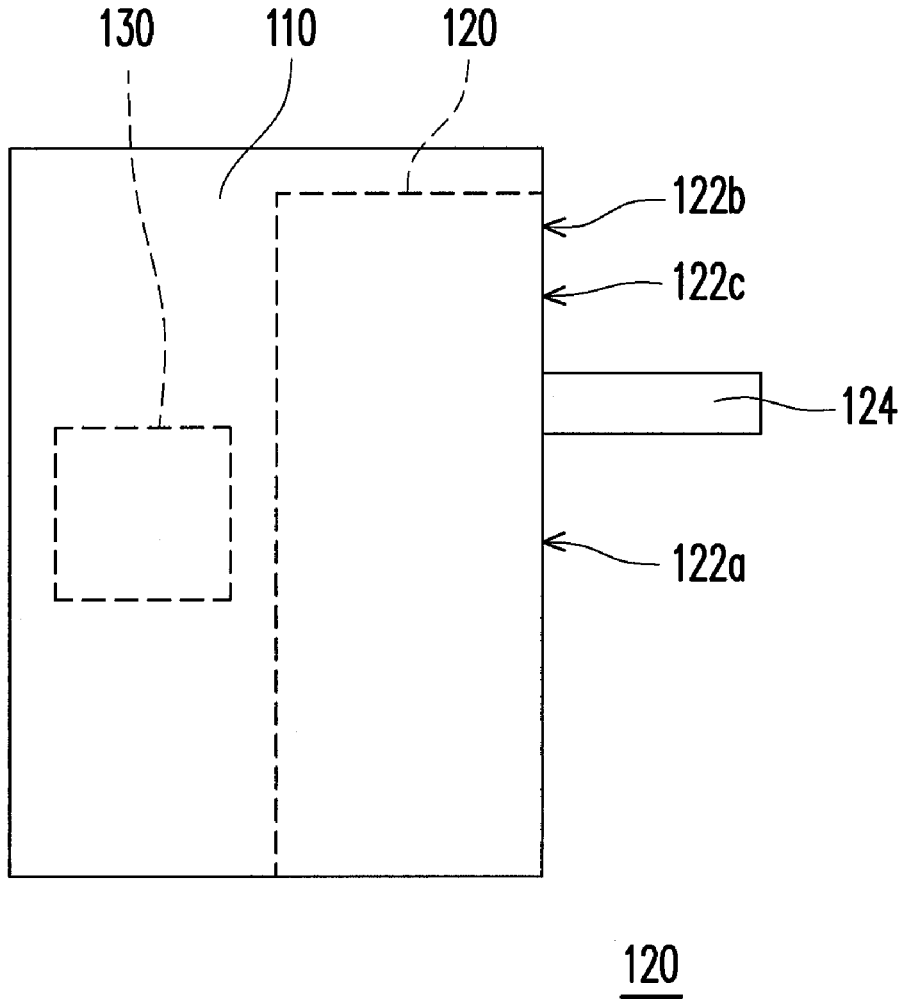
FIG. 1 is a schematic side view of a multi-function peripheral according to an embodiment of the present invention.
Figure 2:
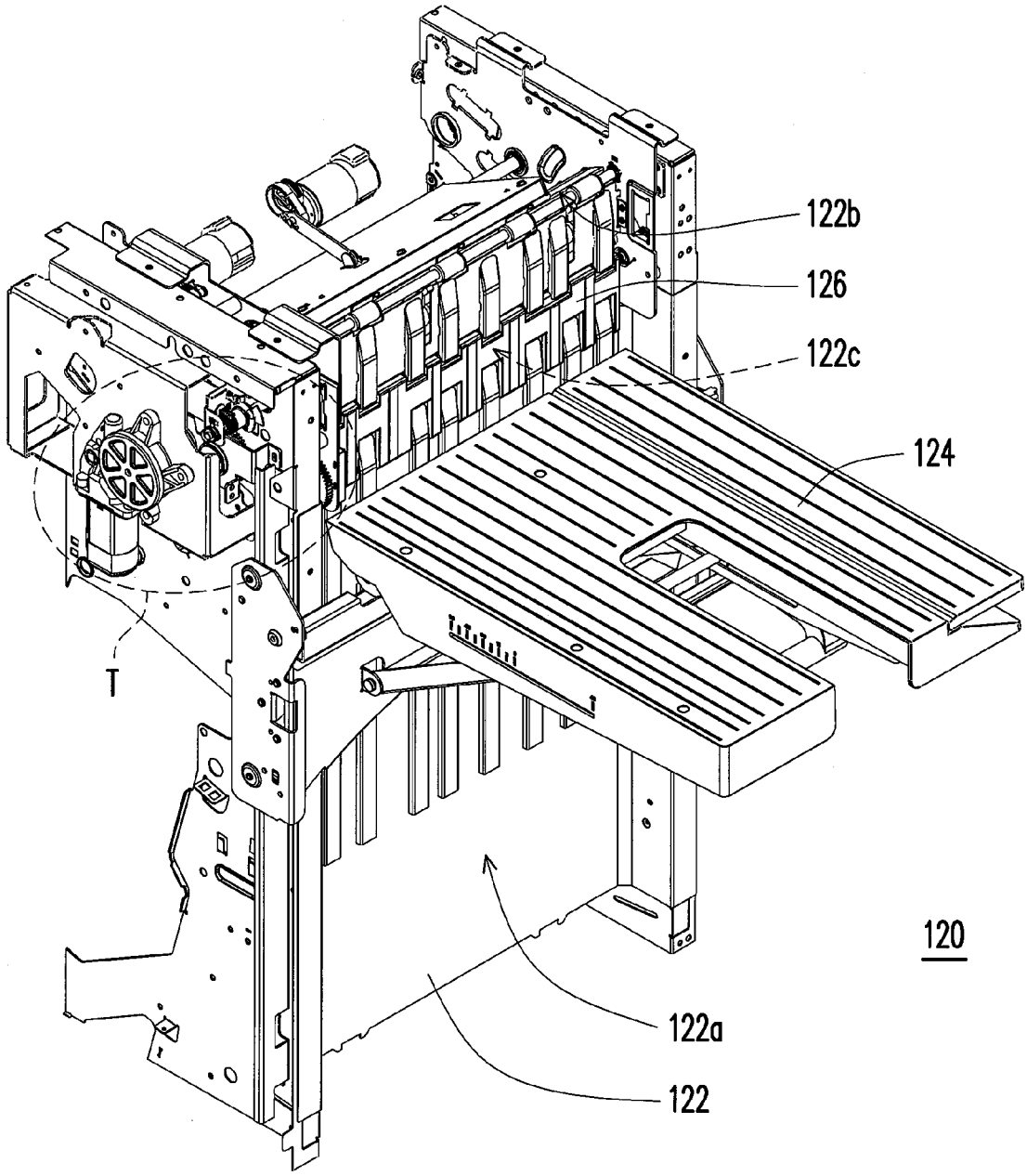
FIG. 2 is a three-dimension view of the paper feeding module of FIG. 1.

FIG. 1 is a schematic side view of a multi-function peripheral according to an embodiment of the present invention. FIG. 2 is a three-dimension view of the paper feeding module of FIG. 1. Referring to both FIGS. 1 and 2, a multi-function peripheral 100 according to the present embodiment includes a main body 110 and a paper feeding module 120. The paper feeding module 120 includes a paper outlet structure 122, a tray 124 and a gate 126. The paper outlet structure 122 is disposed at the main body 110 and has a side 122*a*, a first paper outlet 122*b* disposed on the side 122*a* and a second paper outlet 122*c* disposed on the side 122*a*, wherein the first paper outlet 122*b* is disposed above the second paper outlet 122*c*. The tray 124 is disposed movably up and down on the side 122*a*.

Figure 3A:
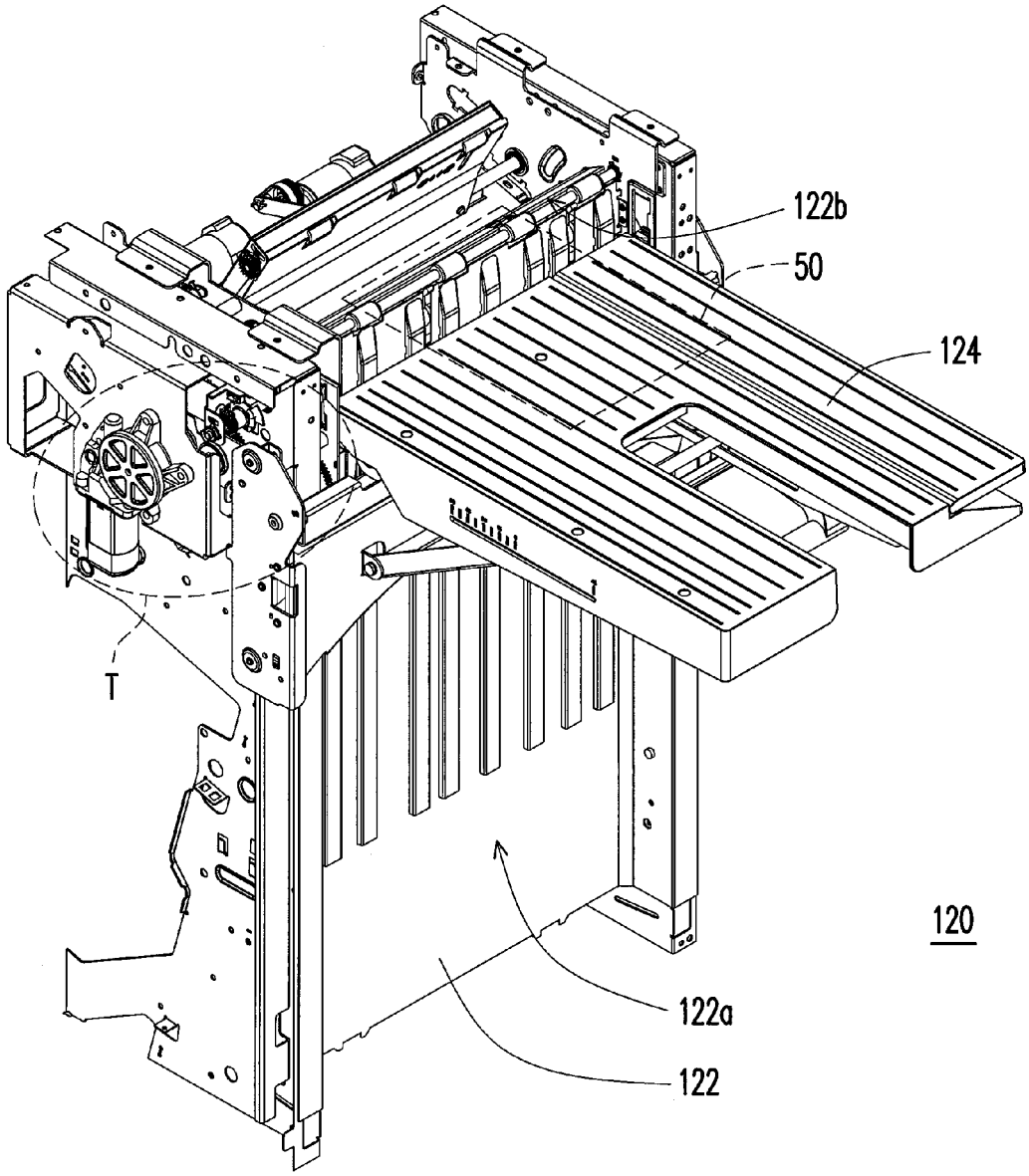
FIGS. 3A and 3B are schematic operational views of the paper feeding module of FIG. 1.
Figure 3B:
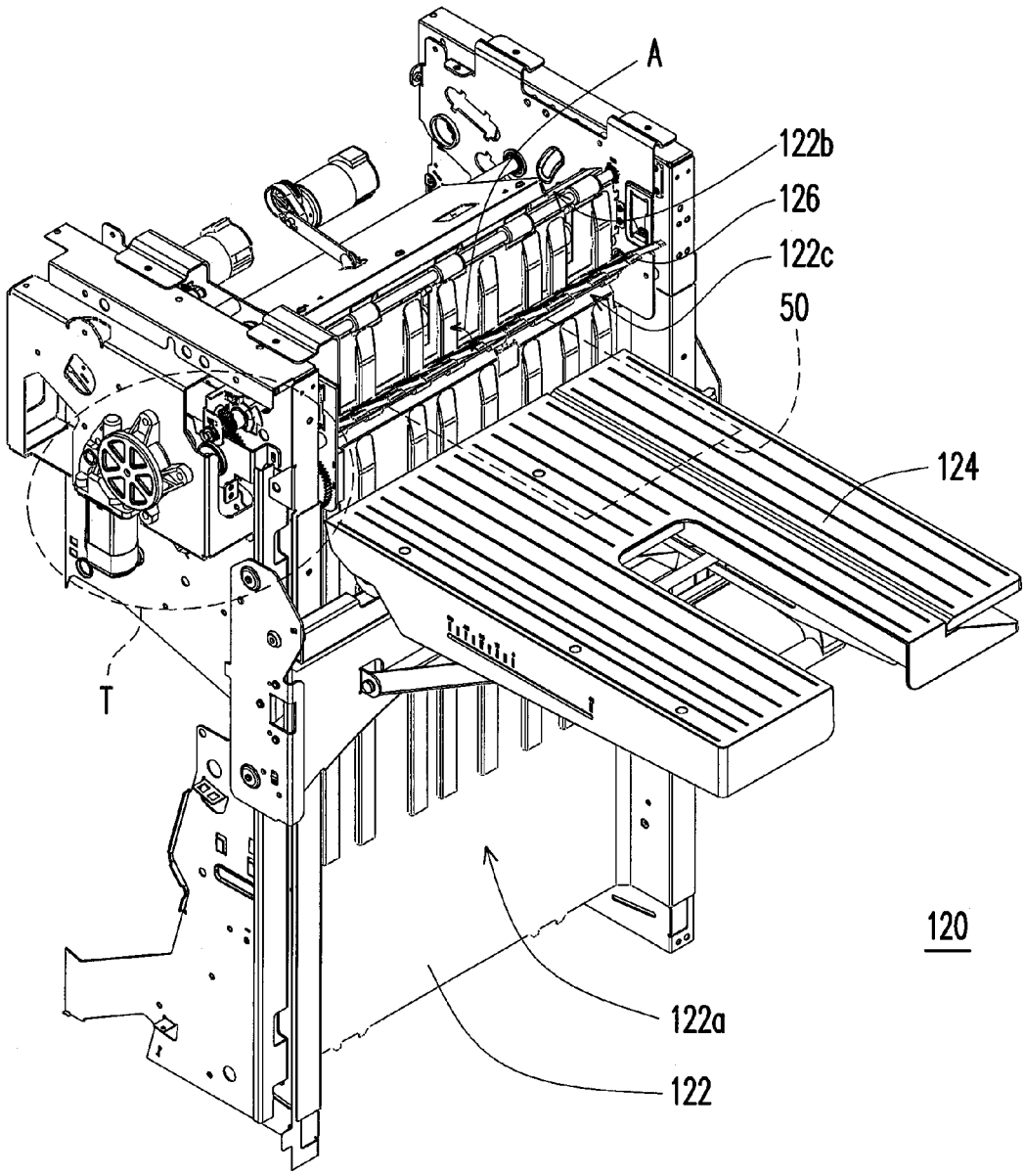
Figure 4:
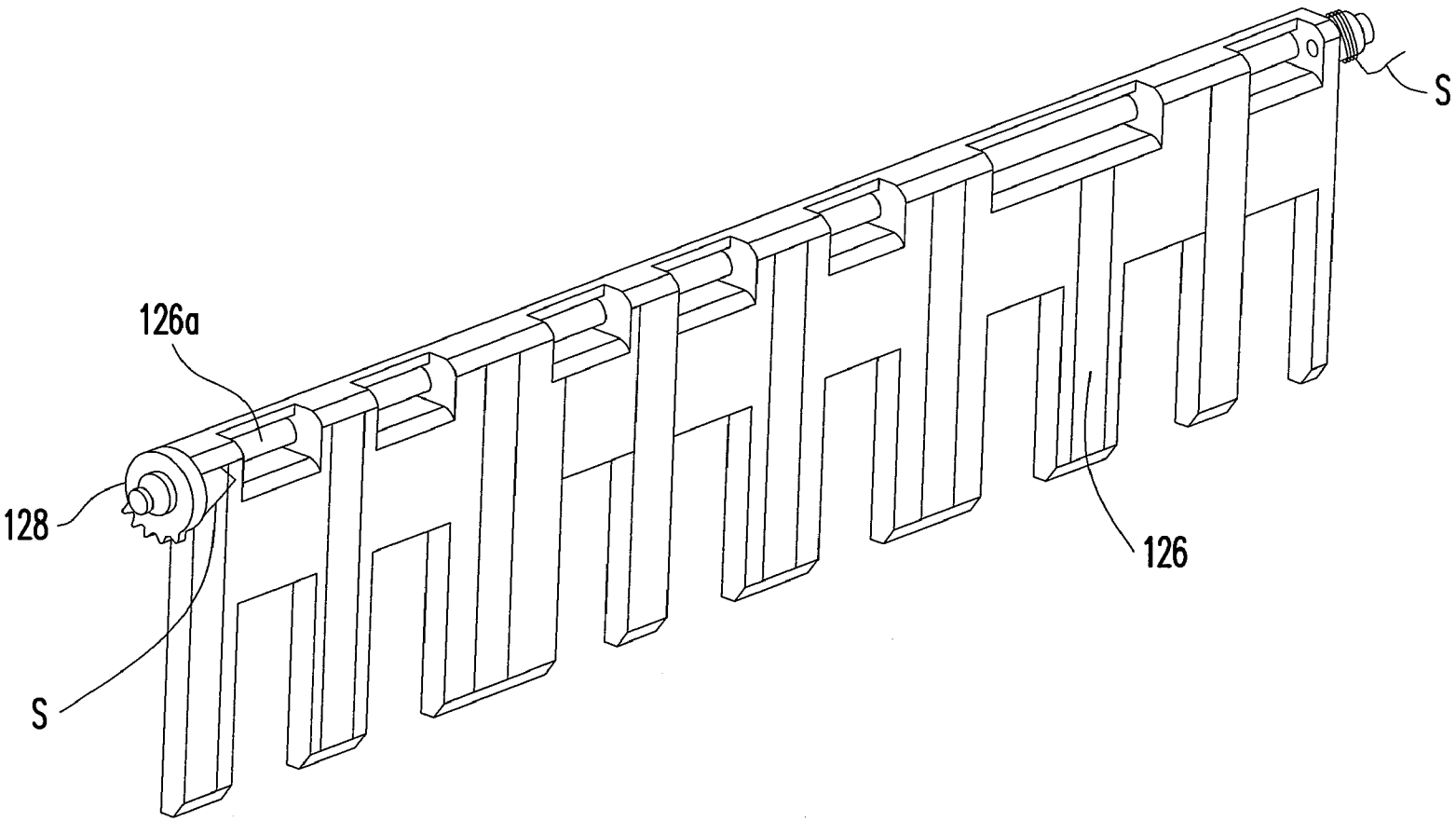
FIG. 4 is a three-dimensional view of a gate of FIG. 2.
Figure 6:
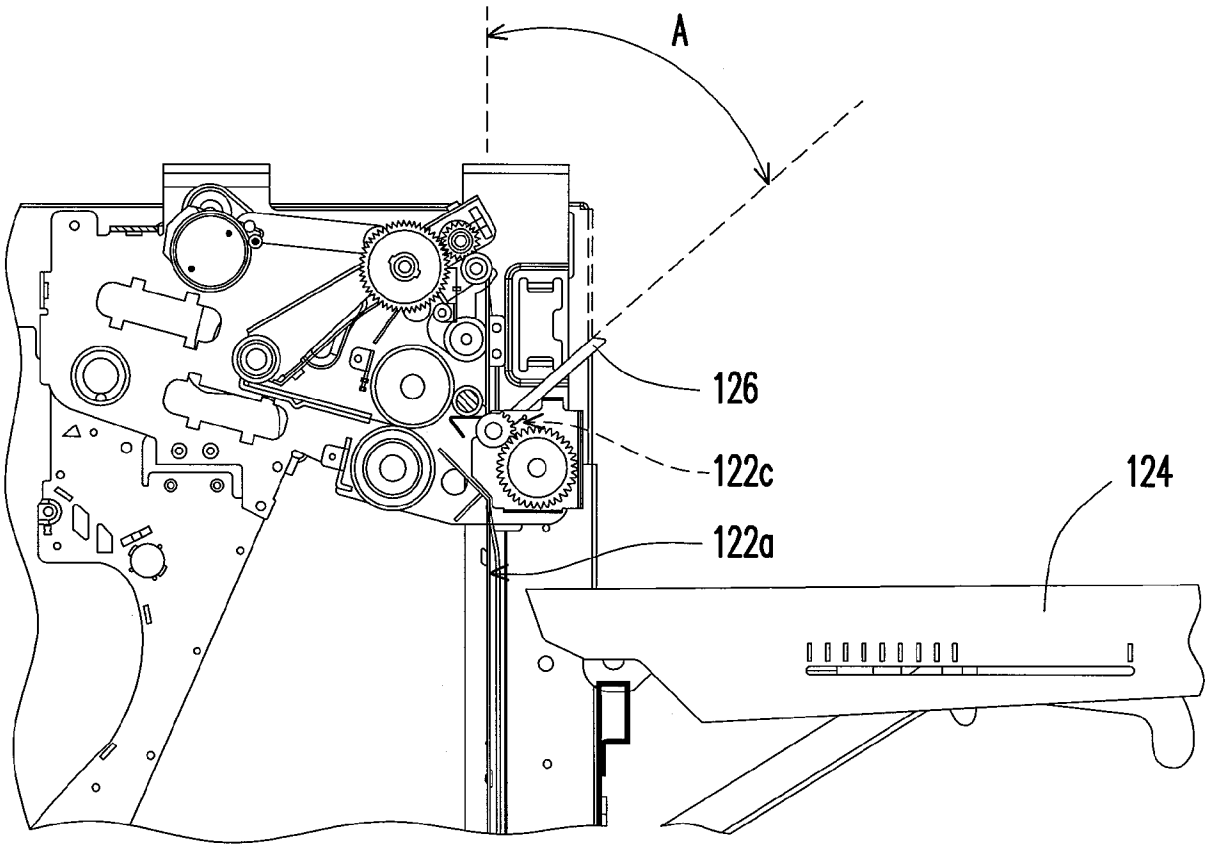
FIG. 6 is an operational sectional view of the paper feeding module of FIG. 3B.

FIGS. 3A and 3B are schematic operational views of the paper feeding module of FIG. 1. FIG. 4 is a three-dimensional view of a gate of FIG. 2. FIG. 6 is an operational sectional view of the paper feeding module of FIG. 3B. Referring to both FIGS. 2 and 4, the gate 126 has a pivoting part 126*a* and is pivoted on the side 122*a* and at the second paper outlet 122*c* using the pivoting part 126*a*. Referring to FIG. 3A, when a paper 50 is fed out from the first paper outlet 122*b*, the tray 124 is disposed below the first paper outlet 122*b*. At this moment, the gate 126 is closed to the side 122*a* and covers the second paper outlet 122*c* (since the gate 126 in FIG. 3A is covered by the tray 124 and cannot be seen, a method of the gate 126 covering the second paper outlet 122*c* is referred to in FIG. 2). Referring to FIG. 3B, when the paper 50 is fed out from the second paper outlet 122*c*, the tray 124 is disposed below the second paper outlet 122*c*; referring to FIG. 6, the gate 126 has a specific angle A relative to the side 122*a* and does not cover the second paper outlet 122*c*.

In other words, the tray 124 moves to below the first paper outlet 122*b* or to below the second paper outlet 122*c* according to whether the paper 50 is fed out from the first paper outlet 122*b* or from the second paper outlet 122*c*, so as to support the paper 50 which is fed out. When the paper 50 is fed out from the first paper outlet 122*b* (as shown in FIG. 3A), the gate 126 covers the second paper outlet 122*c* to prevent the paper 50 fed out from the first paper outlet 122*b* from being inserted into the second paper outlet 122*c*. When the paper 50 is fed out from the second paper outlet 122*c* (as shown in FIG. 3B), the gate 126 rotates upward to have the angle A relative to the side 122*a* and does not cover the second paper outlet 122*c*, so that the paper is fed out from the second paper outlet and is not blocked by the gate 126 (as shown in FIG. 6). In addition, during a process of the tray 124 moving up and down, the gate 126 is in a status of being closed to the side 122*a*, so as to avoid interfering with movement of the tray 124.

Figure 5:
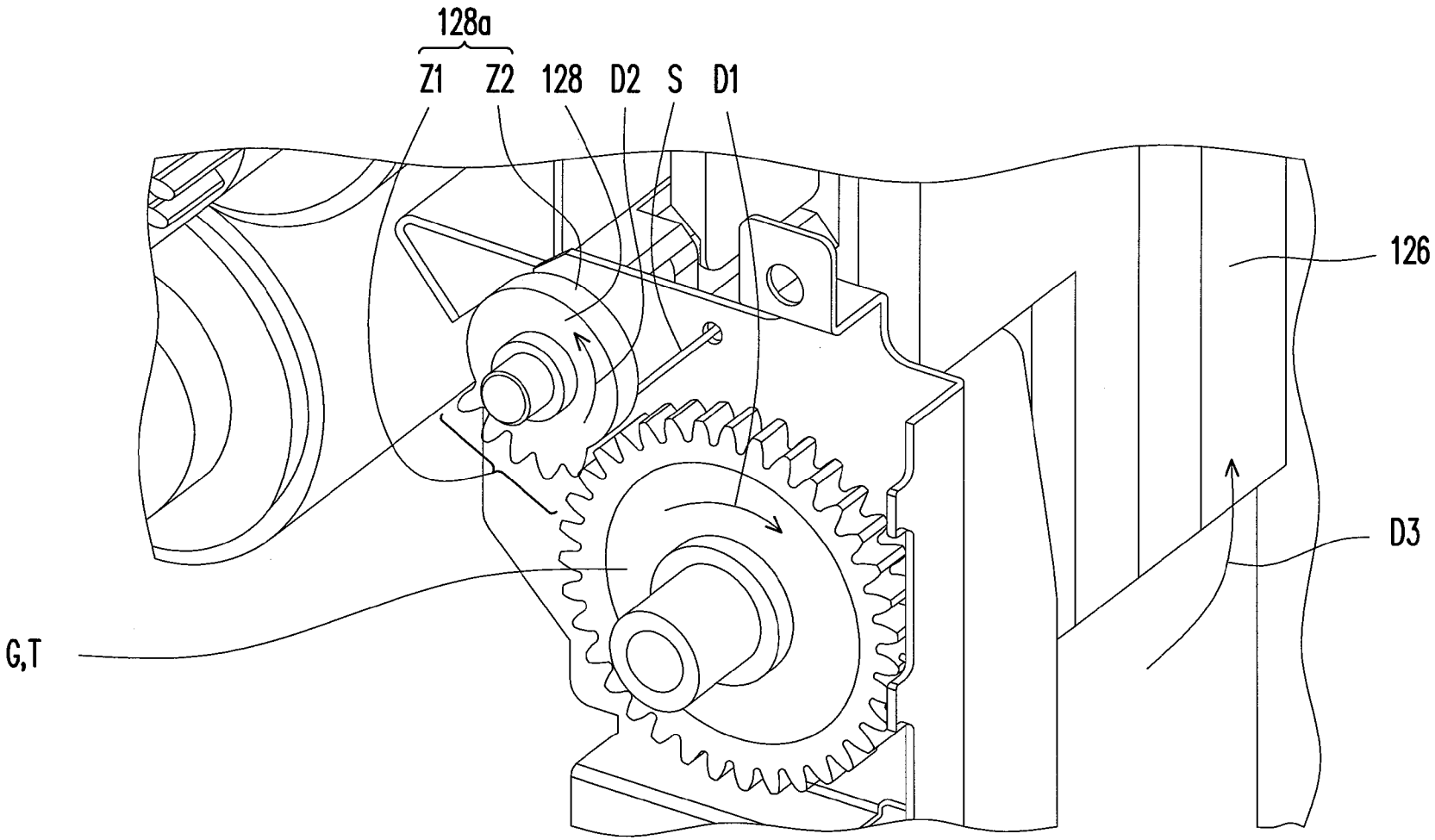
FIG. 5 is a partial three-dimension view of a paper feeding module of FIG. 1.

FIG. 5 is a partial three-dimension view of a paper feeding module of FIG. 1. Please refer to all FIGS. 2, 4 and 5. According to the present embodiment, the paper feeding structure 120 further includes a gear 128 and a transmission structure T. The gear 128 is connected to the pivoting part 126*a* and has a circumference part 128*a*. The circumference part 128*a* has a meshing area Z1 and a non-meshing area Z2. The transmission structure T is coupled to the gear 128, wherein the gear 128 is adapted to be driven by the transmission structure T through the meshing area Z1, so as to make the gate 126 closed to the side 122*a* rotate to the specific angle A (as shown in FIG. 6) or to make the gate 126 rotated to the specific angle A return to being closed to the side 122*a*.

In detail, please refer to FIG. 5; the gear 128 according to the present embodiment is a toothless gear, and the transmission structure T includes a gear G. When the gear G rotates along a direction D1, the gear 128 is driven along a direction D2 by intermeshing with the meshing area Z1, so that the gate 126 using the pivoting part 126*a* (shown in FIG. 4) as a rotating axis is driven to rotate upwards in a direction D3. In particular, when the gear 128 rotates so that the non-meshing area Z2 corresponds to the gear G, the gear G which is continually rotating stops driving the gear 128, so that the gate 126 is fixated in a state having the angle A relative to the side 122*a* (as shown in FIG. 6). It should be noted that the operational procedure in which the gear G drives the gate 126 to return to the state of being closed to the side 122*a* is an opposite operational procedure similar to the above procedure and is not repeatedly described here.

Please refer to both FIGS. 1 and 3B. According to the present embodiment, the multi-function peripheral 100 further includes a paper folding module 130. When the multi-function peripheral 100 performs the paper folding function, the transmission structure 100 drivers the paper folding module 130 to fold the papers 50 and drives the gate 126 to rotate upwards to not cover the second paper outlet 122*c*, so that the papers 50 after being folded are fed out from the second paper outlet 122*c*. In other words, an element used to drive the paper folding module 130 and the gate 126 is the transmission structure T, and such a design of sharing the transmission structure reduces manufacturing costs and saves usage of space.

Please refer to both FIGS. 4 and 5, according to the present embodiment, the paper feeding module 120 (shown in FIG. 1) includes at least a torsion spring S (two torsion springs are shown). The torsion spring S is disposed at the pivoting part 126*a*. Referring to both FIGS. 2 and 4, when the transmission structure T drives the gate 126 to return to being closed to the side 122*a*, the gate 126 completely covers the second opening 122*c* using the elasticity of the torsion spring S. In other words, although the gate 126 returns to the state of covering the second opening 122*c* through driving by the transmission structure, the torsion spring S further ensures that the gate 126 is eventually positioned at the state of completely covering the second opening 122*c*. In addition, a material of the pivoting part 126*a* according to the present embodiment 126*a* is, for example, metal, so as to enhance strength of the structure, thereby avoiding overly large operational forces causing deformation in the structure.

In summary, the paper feeding module of the multi-function peripheral of the present invention has the first paper outlet and the second paper outlet, so as to make papers processed differently (for example papers which are folded and papers which are unfolded) be respectively fed out from the first paper outlet and the second paper outlet and be supported by the tray suitable for moving up and down and corresponding to the first paper outlet or the second paper outlet, so as to achieve effects of classification of the papers and tidy arrangement of the papers.

In addition, when the papers are fed out from the first paper outlet, the gate covers the second paper outlet, so as to avoid the papers fed out from the first paper outlet being inserted into the second paper outlet. When the papers are fed out from the second paper outlet, the gate does not cover the second paper outlet, so that the papers are fed out from the second paper outlet. During the process of the tray moving up and down, the gate is in the status of being closed to the side, so as to avoid interfering with the movement of the tray. In addition, the gate and the paper folding module share the transmission structure, so as to reduce manufacturing costs and save usage of space.

Although the present invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A paper feeding module, adapted to a multi-function peripheral and used to feed out a plurality of papers, the paper feeding module comprising:

a paper outlet structure, having a side, a first paper outlet disposed on the side and a second paper outlet disposed on the side, wherein the first paper outlet is disposed above the second paper outlet, and the papers are adapted to be fed out from the first paper outlet or the second paper outlet;

a tray disposed movably up and down on the side and used to support the papers fed out from the first paper outlet or the second paper outlet;

a gate, having a pivoting part and using the pivoting part to be pivoted on the side and near the second paper outlet, wherein when the papers are fed out from the first paper outlet, the tray is disposed below the first paper outlet and the gate is closed to the side and covers the second paper outlet, and when the papers are fed out from the second paper outlet, the tray is disposed below the second paper outlet and the gate has a specific angle relative to the side and does not cover the second paper outlet;

a gear connected to the pivoting part and having a circumference part, the circumference part having a meshing area and a non-meshing area; and a transmission structure coupled to the gear, wherein the gear is adapted to be driven by the transmission structure using the meshing area, so as to make the gate closed to the side rotate to the specific angle or to make the gate rotated to the specific angle return to being closed to the side.

2. The paper feeding module of claim 1, wherein the multi-function machine comprises a paper folding module, the transmission structure is used to drive the paper folding module to fold the papers, and the papers after being folded are fed out from the second paper outlet.

3. The paper feeding module of claim 1, further comprising at least a torsion spring disposed at the pivoting part, wherein when the transmission structure drives the gate to return to being closed to the side, the gate completely covers the second paper outlet using an elasticity of the torsion spring.

4. The paper feeding module of claim 1, wherein a material of the pivoting part is metal.

5. A multi-function peripheral, comprising:

a main body;

a paper feeding module used to feed out a plurality of papers, the paper feed module comprising:

a paper outlet structure disposed at the main body and having a side, a first paper outlet disposed on the side and a second paper outlet disposed on the side, wherein the first paper outlet is disposed above the second paper outlet, and the papers are adapted to be fed out from the first paper outlet or the second paper outlet;

a tray disposed movably up and down on the side and used to support the papers fed out from the first paper outlet or the second paper outlet;

a gate, having a pivoting part and using the pivoting part to be pivoted on the side and near the second paper outlet, wherein when the papers are fed out from the first paper outlet, the tray is disposed below the first paper outlet and the gate is closed to the side and covers the second paper outlet, and when the papers are fed out from the second paper outlet, the tray is disposed below the second paper outlet and the tray has a specific angle relative to the side and does not cover the second paper outlet;

a gear connected to the pivoting part and having a circumference part, the circumference part having a meshing area and a non-meshing area; and a transmission structure coupled to the gear, wherein the gear is adapted to be driven by the transmission structure using the meshing area, so as to make the gate closed to the side rotate to the specific angle or to make the gate rotated to the specific angle return to being closed to the side.

6. The multi-function peripheral of claim 5, further comprising a paper folding module, wherein the transmission structure is used to drive the paper folding module to fold the papers, and the papers after being folded are fed out from the second paper outlet.

7. The multi-function peripheral of claim 5, wherein the paper feeding module further comprises a torsion spring disposed at the pivoting part, and when the transmission structure drives the gate to return to being closed to the side, the gate completely covers the second paper outlet using an elasticity of the torsion spring.

8. The multi-function peripheral of claim 5, wherein a material of the pivoting part is metal.

* * * * *